US009416573B2

(12) United States Patent
Sabrowski

(10) Patent No.: US 9,416,573 B2
(45) Date of Patent: Aug. 16, 2016

(54) DOOR HINGE

(75) Inventor: Uwe Sabrowski, Rheda-Wiedenbrück (DE)

(73) Assignee: Simonswerk, Gesellschaft mit beschränkter Haftung, Rheda-Wiedenbrueck (DE)

( * ) Notice: Subject to any disclaimer, the term of this patent is extended or adjusted under 35 U.S.C. 154(b) by 1330 days.

(21) Appl. No.: 12/082,827

(22) Filed: Apr. 15, 2008

(65) Prior Publication Data

US 2008/0263822 A1 Oct. 30, 2008

(30) Foreign Application Priority Data

Apr. 27, 2007 (DE) ..... 10 2007 019 938

(51) Int. Cl.
*E05D 7/04* (2006.01)
*E05D 3/02* (2006.01)

(52) U.S. Cl.
CPC ..... *E05D 7/0415* (2013.01); *E05D 7/0423* (2013.01); *E05D 2003/025* (2013.01); *E05D 2007/0461* (2013.01); *E05D 2007/0469* (2013.01); *E05D 2007/0476* (2013.01); *E05Y 2201/638* (2013.01); *E05Y 2800/268* (2013.01); *E05Y 2900/132* (2013.01); *Y10T 16/5321* (2015.01)

(58) Field of Classification Search
USPC ..... 16/235, 236, 237, 238, 239, 240, 241, 16/242, 243, 245, 246, 247, 248, 249
See application file for complete search history.

(56) References Cited

U.S. PATENT DOCUMENTS

| | | | | |
|---|---|---|---|---|
| 3,965,532 | A * | 6/1976 | Wigfall | 16/270 |
| 5,701,636 | A | 12/1997 | Jahnke | |
| 5,799,370 | A | 9/1998 | Davidian et al. | |
| 7,571,516 | B2 * | 8/2009 | Lueffe et al. | 16/382 |
| 2006/0179610 | A1 * | 8/2006 | Erickson et al. | 16/243 |
| 2007/0028420 | A1 * | 2/2007 | Lueffe et al. | 16/382 |
| 2007/0143959 | A1 * | 6/2007 | Chung | 16/236 |
| 2008/0022491 | A1 * | 1/2008 | Campbell et al. | 16/236 |
| 2008/0104799 | A1 * | 5/2008 | Hoppe et al. | 16/238 |

FOREIGN PATENT DOCUMENTS

| | | |
|---|---|---|
| DE | 44 21 056 | 12/1995 |

* cited by examiner

*Primary Examiner* — Jeffrey O Brien
(74) *Attorney, Agent, or Firm* — Collard & Roe, P.C.

(57) ABSTRACT

A door hinge has a first hinge plate connected with a second hinge plate that is adjustably disposed in a hinge accommodation element, so as to pivot, with a pin on a hinge roll. The hinge accommodation element has a front part and a rear part, and the second hinge plate is guided in the hinge accommodation element so as to move in the vertical direction, and can be tilted in the horizontal direction, relative to the hinge accommodation element, with an adjustment screw. The front part and the rear part of the hinge accommodation element are connected by a connection screw, and the second hinge plate is clamped in place between the front part and the rear part, so that it cannot be displaced in the vertical direction, after the connection screw has been tightened. A hinge system can be formed by three of these door hinges.

7 Claims, 5 Drawing Sheets

Fig.3a
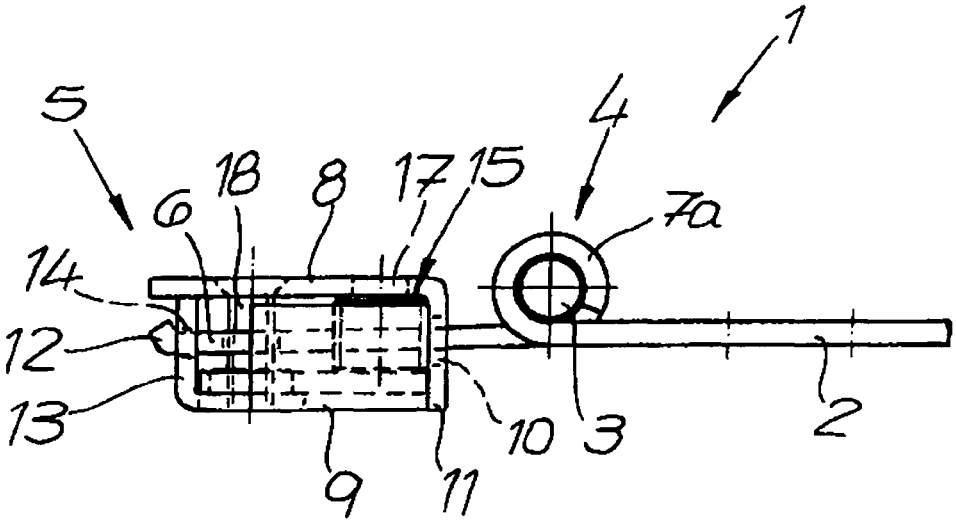
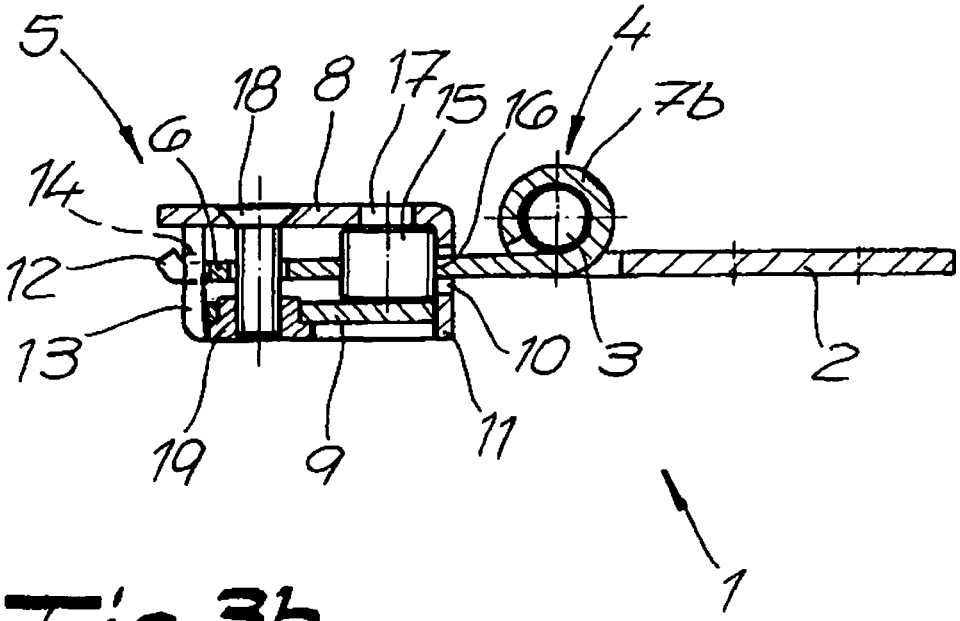
Fig.3b

DOOR HINGE

CROSS REFERENCE TO RELATED APPLICATIONS

Applicant claims priority under 35 U.S.C. §119 of German Application No. 10 2007 019 938.6 filed Apr. 27, 2007.

BACKGROUND OF THE INVENTION

1. Field of the Invention

The invention relates to a door hinge having a first hinge plate that is connected with a second hinge plate. The second hinge plate is adjustably disposed in a hinge accommodation element, so as to pivot with a pin on a hinge roll. The hinge accommodation element is formed from a front part and a rear part, and the second hinge plate is guided in the hinge accommodation element so as to move in the vertical direction, and can be tilted in the horizontal direction relative to the hinge accommodation element, with an adjustment screw. A hinge system formed by three door hinges is also part of the invention. The door hinge pivotally attaches a door leaf to a door frame, and the pivot axis defined by the hinge roll runs in the vertical direction. By adjusting the hinge in the horizontal direction, the lateral rabbet clearance, i.e. the lateral gap between door leaf and frame, is adjustable with reference to the alignment of the door leaf in the closed state. The door hinge is preferably used for interior doors in the residential or commercial sector.

2. The Prior Art

A door hinge is described in U.S. Pat. No. 5,799,370 A. The hinge accommodation element in this door hinge has a front part and a rear part, and the second hinge plate is held so that it can tilt relative to the hinge accommodation element, about an axle pin. An adjustment means is provided both for tilting the second hinge plate in the horizontal direction and for an adjustment in the vertical direction. The adjustment in the horizontal direction takes place using an adjustment screw that is mounted between the front part and the rear part of the hinge accommodation element, and passes through a threaded bore of the second hinge plate. For the adjustment in the vertical direction, an eccentric is provided, which engages into a related recess of the second hinge plate. The eccentric and the adjustment screw are accessible with a tool, through a hole and an elongated hole, respectively, of the front part of the hinge accommodation element. If a door leaf is attached to a door frame with several of the door hinges described, final setting in the vertical direction is difficult, since jam-free adjustment is only possible when simultaneously activating all the eccentrics. In order to hold the door hinge in a predetermined vertical position even under stress, the eccentric has a toothing that interacts with a related counter-plate. Handling of the door hinge and the production effort require improvement.

A door hinge system consisting of three door hinges is described in German Patent Application No. DE 44 21 056 A1. Here, the door hinges each have a first hinge plate that is connected with a second hinge plate adjustably disposed in a hinge accommodation element, so as to pivot with a pin, on a hinge roll. While all the hinge accommodation elements have an adjustment screw for adjustment in the horizontal direction, an adjustment element for adjustment in the vertical direction is provided only in the center door hinge. The two hinge plates of the uppermost and lowermost door hinge are each guided displaceably in the related hinge accommodation element. While a simple adjustment in the vertical direction is possible with the configuration described, great stress is exerted on the center hinge, since practically all the weight force of the door leaf rests on it. Furthermore, the production effort of the door hinges is also great.

SUMMARY OF THE INVENTION

With this background, it is therefore an object of the invention to provide a door hinge as well as a hinge system having the characteristics described initially, which are easy to produce, install, and adjust, and which have good functional properties.

This object is accomplished, according to the invention, by a door hinge in which the front part and the rear part are connected by a connection screw, and the second hinge plate is clamped in place between the front hinge part and the rear hinge part, so that it cannot be displaced in the vertical direction, after the connection screw has been tightened. According to the invention, the second hinge plate is freely movable in the vertical direction before the connection screw is tightened, and is then fixed in place by tightening the connection screw. Then, the door hinge can also absorb forces in the vertical direction after the connection screw is tightened. The adjustment in the vertical direction can take place before tightening the connection screw, by means of manual lifting or lowering of the door leaf. Preferably, however, a door hinge is used that has an adjustment element for the vertical direction. When the connection screw is tightened, the front part and the rear part of the hinge accommodation element are moved toward one another, and the two parts are provided with play, so that during tightening, the second hinge plate is clamped tight between them. Clamping can take place either by way of the second hinge plate itself, or preferably by way of the adjustment screw for the adjustment in the horizontal direction.

In one embodiment, the front part and the rear part of the hinge accommodation element are structured as sheet-metal parts. Such a configuration allows particularly cost-advantageous production, since the two hinge plates can also be formed from sheet metal. The door hinge according to the invention is inserted into milled-out areas of a frame and a door leaf, with its first hinge plate and with the hinge accommodation element. The hinge accommodation element and the first hinge plate are visible in the installed state, when the door is open. The visible parts of the door hinge are therefore preferably made from a high-quality material, for example a stainless steel sheet, and the surfaces can be ground, brushed, polished, or also coated.

The second hinge plate is inserted into the hinge accommodation element at one of its narrow sides, and the front sheet-metal part on the narrow side preferably has an angled shank having an opening. The second hinge plate is then inserted into the hinge accommodation element through the opening in the angled shank. A tilting arrangement of the second hinge plate in the hinge accommodation element, in the horizontal direction, is possible in a particularly simple manner if the second hinge plate has projections on its end facing away from the hinge loop, which projections are guided in vertical slits on a bent section of the rear sheet-metal part. With such an arrangement, the second hinge plate can be tilted about the axis defined by the vertical slits. The end sections of the projections that project out of the slits are preferably bent down.

However, aside from the mounting of the second hinge plate in the hinge accommodation, with tilting movement as described, which is particularly simple in design, other arrangements are also possible, such as those shown in U.S. Pat. No. 5,799,370 A.

The first hinge plate and the front part of the hinge accommodation element typically have bores for attachment to a door leaf or a door frame. Since the first hinge plate and the front part of the hinge accommodation element usually remain visible when a door is open, the bores for accommodating screws with counter-sunk heads are preferably counter-sunk. The front part of the hinge accommodation element can be structured in such a manner that it can completely fill a related milled-out area in a door leaf or a door frame. For this purpose, the front part must completely cover the rear part of the hinge accommodation element.

In the region of the hinge roll, a hinge roll section of one of the hinge plates is preferably disposed between two hinge roll sections of the other hinge plate. The hinge roll sections are connected by a vertical pin and sleeves or shims are preferably disposed between the hinge roll sections, which contribute to reducing friction and wear.

The invention also comprises a hinge system having a first door hinge and a second door hinge, which are each structured as described above, as well as a third door hinge having a first hinge plate that is connected with a second hinge plate adjustably disposed in a hinge accommodation element, so as to pivot, with a pin, on a hinge roll. The second hinge plate is mounted so it can tilt in the horizontal direction, relative to the hinge accommodation element, and the second hinge plate is adjustable in the hinge accommodation element, in the vertical direction, using an adjustment element. The hinge system is used for attaching a door leaf to a door frame, and the third door hinge is preferably disposed in the center between the first and the second door hinge, in the vertical direction. Positioning of the door leaf in the vertical direction takes place with the third door hinge, and the adjustment in the horizontal direction takes place using the first and second door hinge. After adjustment of the door leaf, the connection screws in the first and second door hinges are tightened, thereby causing each of the related second hinge plates to be non-displaceably clamped in place. The hinge system therefore allows particularly simple adjustment of both the horizontal and the vertical alignment of the door leaf, and after adjustment, the weight of the door leaf is carried by all three hinges. Aside from the adjustment element, which is preferably configured as an eccentric, and the free tiltability of the second hinge plate, the third door hinge can be configured with the same design as the first and the second door hinge.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 3*a* shows the door hinge according to FIG. 2 in a view from above;

FIG. 3*b* shows a sectional view of the door hinge along lines III-III of FIG. 2;

DETAILED DESCRIPTION OF THE PREFERRED EMBODIMENT

Figure 1:
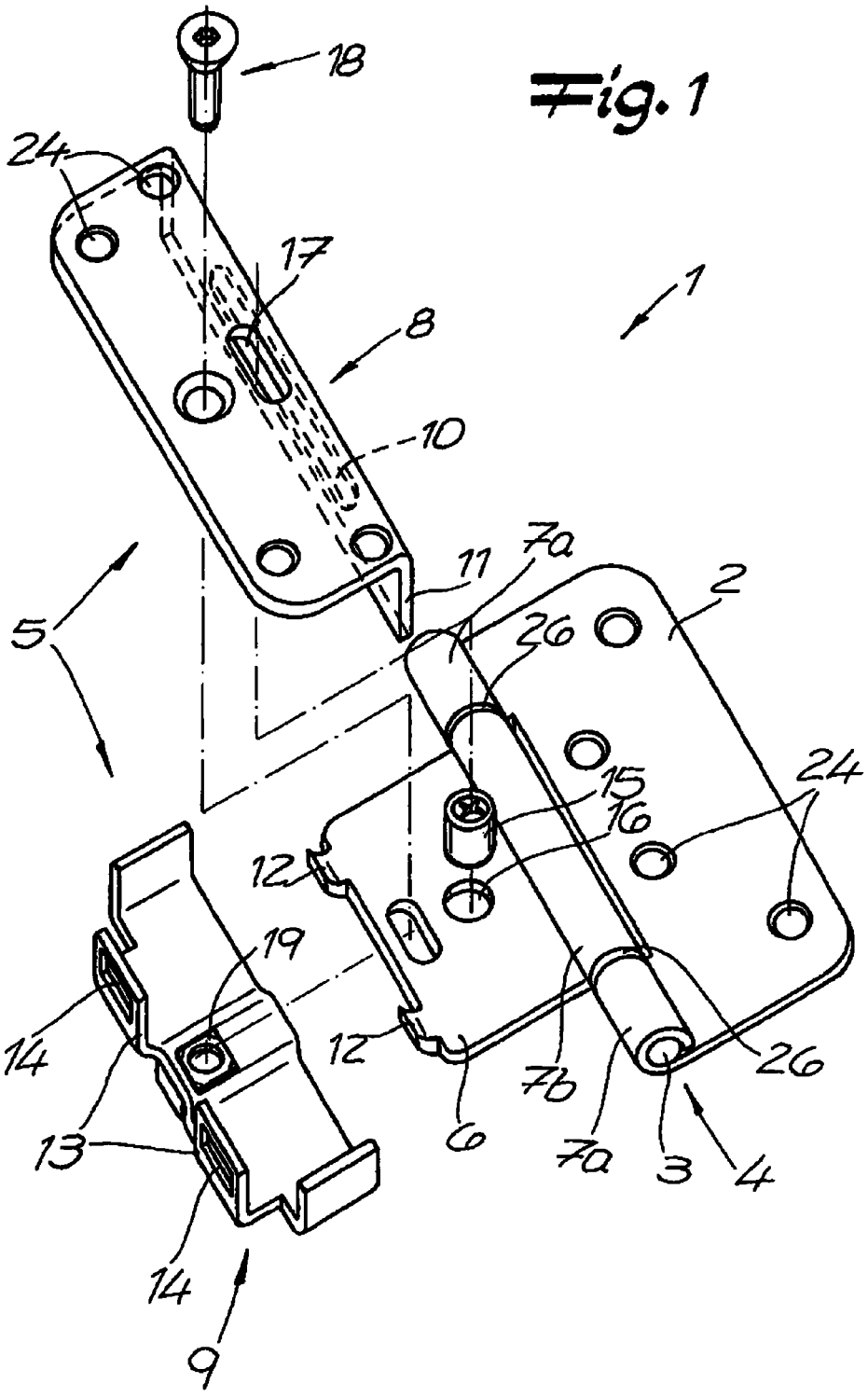
FIG. 1 shows an exploded view of the door hinge according to the invention.

Referring now in detail to the drawings, FIG. 1 shows a door hinge 1 according to the invention in an exploded view. Door hinge 1 has a first, planar hinge plate 2 that is connected with a second hinge plate 6 that is adjustably disposed in a hinge accommodation element 5, so as to pivot, with a pin 3, on a hinge roll 4. In the region of hinge roll 4, pin 3 passes through two hinge roll sections 7*a* of first hinge plate 2 and a hinge roll section 7*b* of second hinge plate 6 that is disposed between them. Hinge accommodation element 5 is made from a front sheet-metal part 8 and a rear sheet-metal part 9. Hinge plates 2, 6 are also made from sheet metal. In the case of an assembled door hinge 1, second hinge plate 6 is inserted into hinge accommodation element 5 through an opening 10 in an angled shank 11 of the front sheet-metal part 8. Second hinge plate 6 has two projections 12 at its end facing away from hinge roll 4, which projections are guided in vertical slits 14 on a bent section 13 of the rear sheet-metal part 9. Projections 12, which are angled away at their end sections, and the related vertical slits 14 define a tilt axis about which second hinge plate 6 can be tilted relative to hinge accommodation element 5. To adjust the tilt angle, an adjustment screw 15 is provided between front sheet-metal part 8 and rear sheet-metal part 9, which screw is held in a related threaded bore 16 of second hinge plate 6 with its outside thread.

Figure 2:
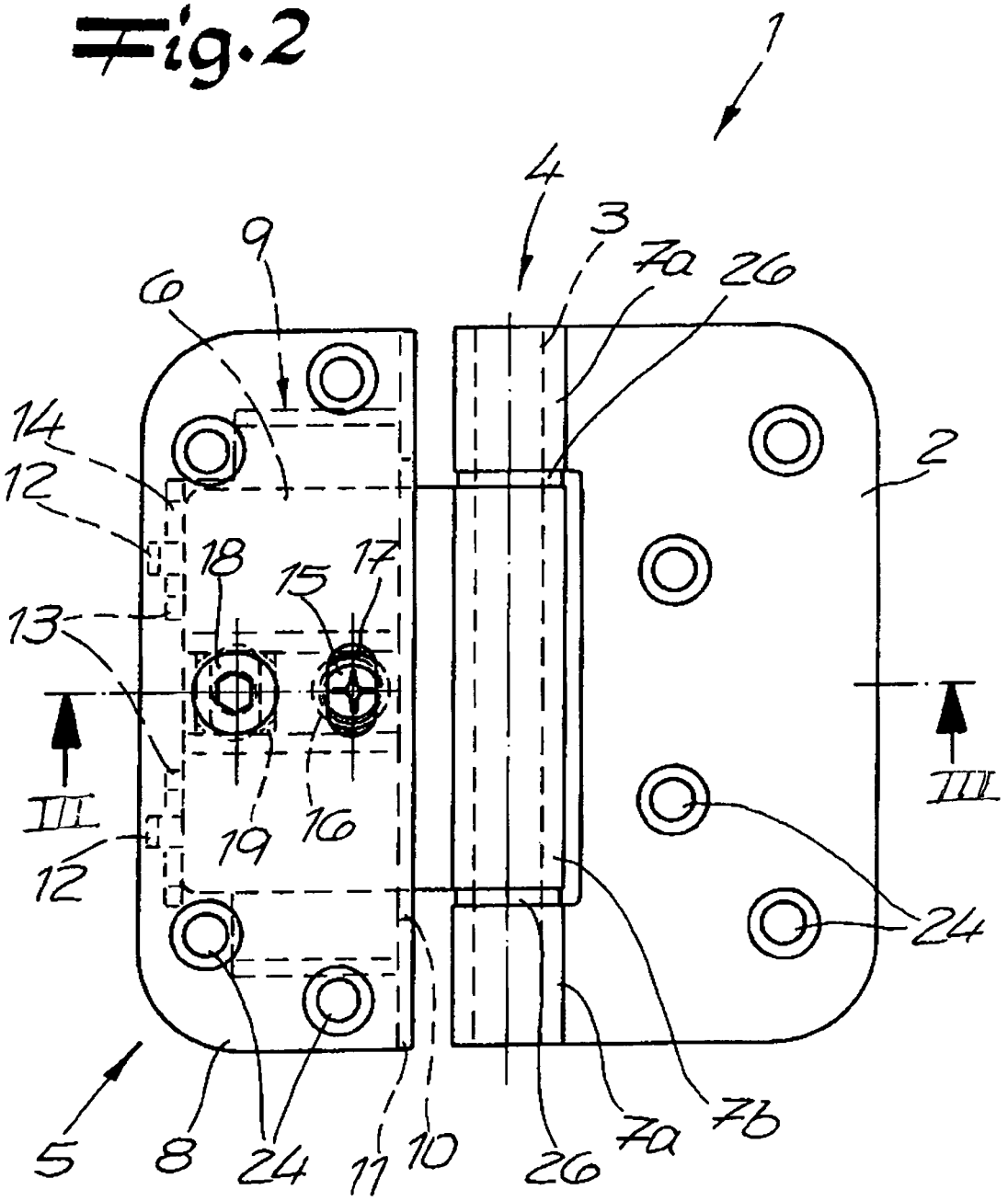
FIG. 2 shows a view of the door hinge according to the invention, from the front.

As can be seen in FIG. 2, adjustment screw 15 is accessible through an elongated hole 17 in front sheet-metal part 8, which is smaller than the head of adjustment screw 15. A connection screw 18 is provided to connect front sheet-metal part 8 and rear sheet-metal part 9.

It can be seen in FIG. 3*a* that a certain play is provided between front sheet-metal part 8 and rear sheet-metal part 9. When connection screw 18 is not tightened, second hinge plate 6 is movable in hinge accommodation element 5, in the vertical direction, and second hinge plate 6 is clamped tight between front sheet-metal part 8 and rear sheet-metal part 9, so that it cannot be displaced in the vertical direction, by means of tightening the connection screw 18. When connection screw 18 is tightened, front sheet-metal part 8 and rear sheet-metal part 9 are moved toward one another, whereby then, in the exemplary embodiment shown, adjustment screw 15 connected with second hinge plate 6 is clamped in tight. In order to subsequently still allow an adjustment in the horizontal direction, it might be necessary, in an individual case, to slightly loosen connection screw 18 again, and to tighten it again after the adjustment in the horizontal direction. In order to avoid bending of rear sheet-metal part 9 when connection screw 18 is tightened, connection screw 18 engages into a threaded plate 19 that is riveted in place, which guarantees a uniform distribution of force.

Figure 4:
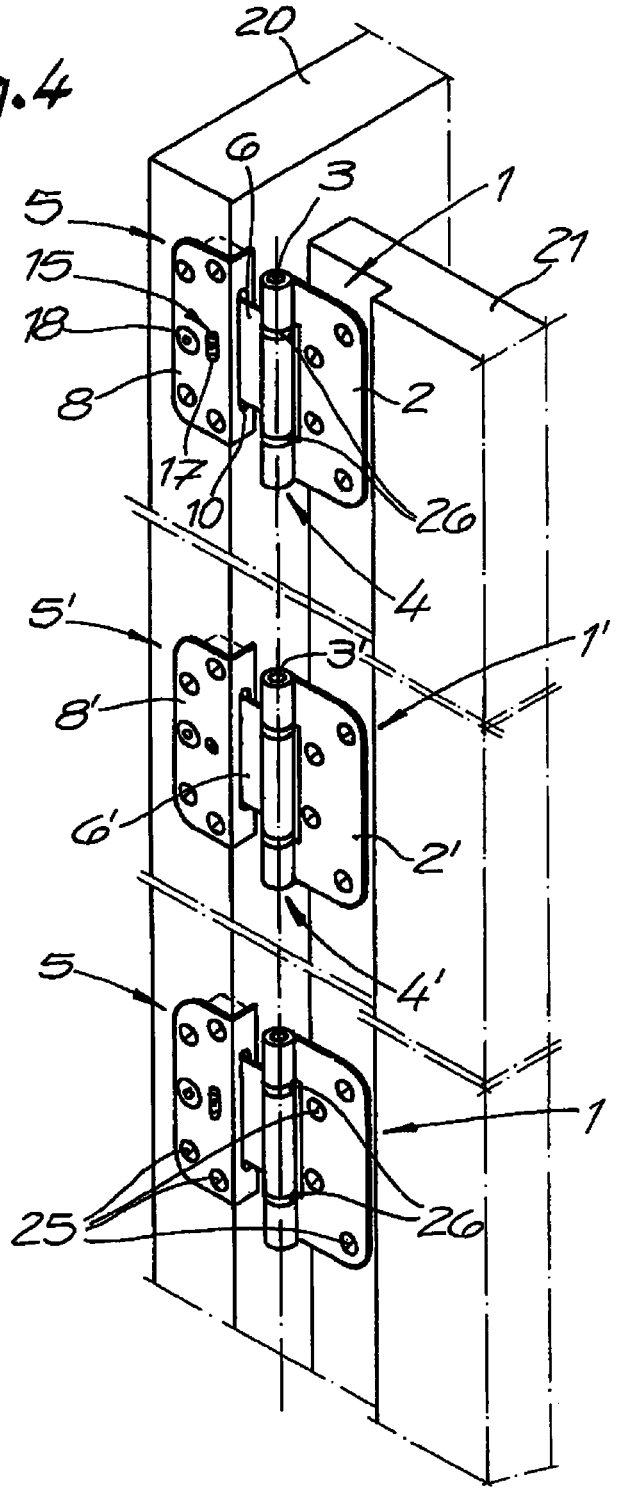
FIG. 4 shows a door having a door hinge system according to the invention.
Figure 5:
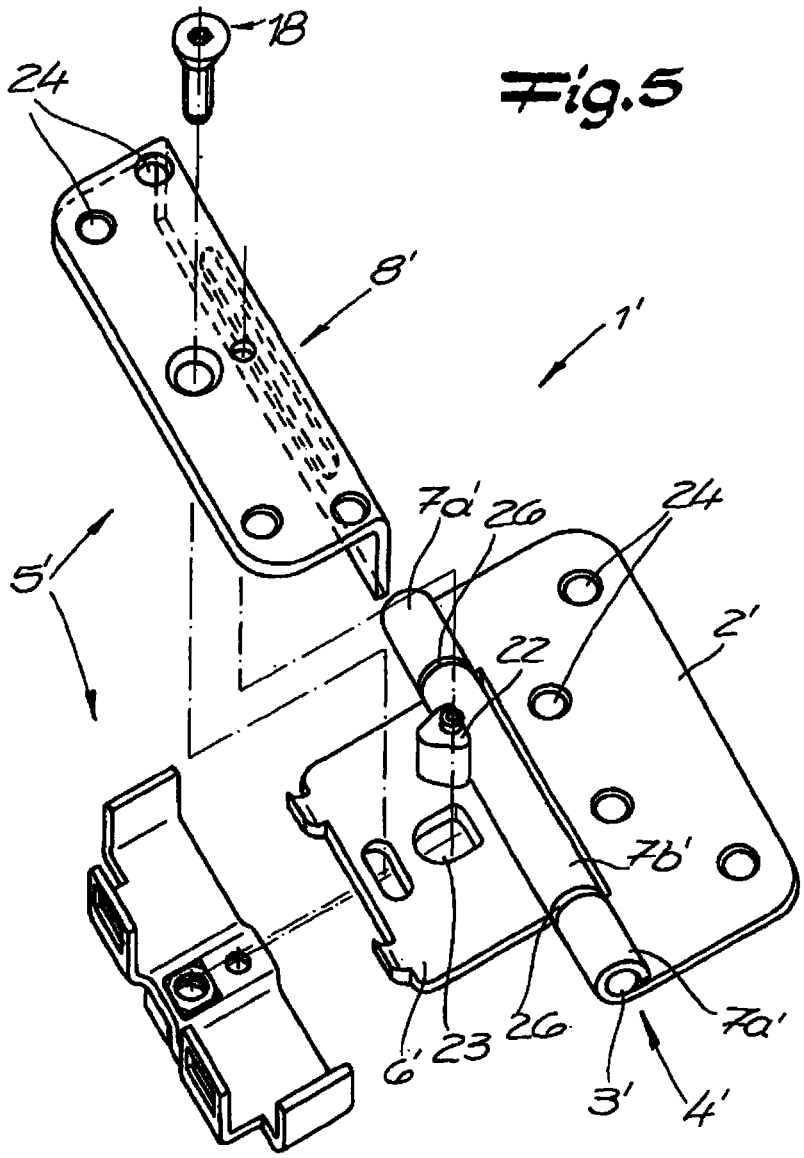
FIG. 5 shows an exploded view of the center door hinge of FIG. 4.

FIG. 4 shows a door where a door leaf 20 is attached to a door frame 21 with a door hinge system formed from three door hinges 1, 1'. The uppermost and the lowermost door hinges 1 are configured as described above. Center door hinge 1', like upper and lower door hinge 1, also has a first hinge plate 2' made from sheet metal, which is connected to a second hinge plate 6' adjustably disposed in a hinge accommodation element 5', so as to pivot, with a pin 3', on a hinge roll 4'. However, second hinge plate 6' is mounted to tilt freely relative to hinge accommodation element 5', in the horizontal direction, and second hinge plate 6' of the center, third door hinge 1' is adjustable in the vertical direction in related hinge accommodation element 5', using an adjustment element configured as an eccentric 22. In this connection, the eccentric 22 engages into a related recess 23 of second hinge plate 6'. The door hinge system shown in FIG. 4 allows precise positioning of door leaf 20 in the vertical direction using center door hinge 1', and positioning in the horizontal direction using the uppermost and lowermost door hinge 1. After connection screws 18 of the uppermost and lowermost door hinge 1 are tightened, the weight of door leaf 20 is distributed onto all three door hinges 1, 1'.

In the exemplary embodiment, door frame 21 and door leaf 20 consist of wood, and first hinge plate 2, 2' the hinge accommodation element 5, 5' of each of the three door hinges 1, 1' shown in FIG. 4 are set into a related milled-out area, and are visible when the door is open. The visible parts of door hinges 1, 1' are produced from stainless steel sheet. This sheet metal can preferably be ground, brushed, polished, or provided with a coating, in order to improve its appearance. The thickness of the sheet metal must be selected in accordance with the weight of door leaf 20. In the exemplary embodiment, the thickness of the stainless steel sheet for first hinge plate 2, 2' and second hinge plate 6, 6' is approximately 2.4 mm, and the thickness of the stainless steel sheet for the parts of the hinge accommodation element 5, 5' is approximately 2 mm. Bores 24 in the first hinge plate 2, 2' and front sheet-metal parts 8, 8' are counter-sunk for a flush accommodation of screws 25 having countersunk heads. A sleeve or slip ring 26 is provided between the individual hinge loop sections 7*a*, 7*b*, 7*a*', 7*b*', in usual manner, to reduce friction and wear.

Accordingly, while only a few embodiments of the present invention have been shown and described, it is obvious that many changes and modifications may be made thereunto without departing from the spirit and scope of the invention.

What is claimed is:

1. A door hinge comprising:

a first hinge plate;

a second hinge plate that is connected with the first hinge plate;

a hinge accommodation element in which said second hinge plate is adjustably disposed, so as to pivot, with a pin, on a hinge roll, said hinge accommodation element being formed from a front part and a rear part that are connected by a connection screw;

wherein the second hinge plate is guided in the hinge accommodation element so as to move in a vertical direction, and has projections on its end facing away from the hinge roll, said projections being guided in vertical slits on a bent section of the rear part;

wherein the second hinge plate can be tilted in a horizontal direction, relative to the hinge accommodation element, with an adjustment screw, said adjustment screw having an outside thread and being held in a corresponding threaded bore of the second hinge plate with said outside thread; and wherein the second hinge plate is clamped in place between the front part and the rear part of the accommodation element by the adjustment screw, so that the second hinge plate cannot be displaced in the vertical direction, after the connection screw has been tightened.

2. The door hinge according to claim 1, wherein the front part and the rear part of the hinge accommodation element are structured as sheet-metal parts.

3. The door hinge according to claim 2, wherein the front part has an angled shank and wherein the second hinge plate is inserted into the hinge accommodation element through an opening in the angled shank.

4. The door hinge according to claim 1, wherein the first hinge plate has bores for attachment to a door leaf or to a door frame.

5. The door hinge according to claim 1, wherein the front part completely covers the rear part of the hinge accommodation element and has bores for attachment to a door leaf or a door frame.

6. A hinge system having a first and a second door hinge according to claim 1, as well as a third door hinge, the third door hinge comprising:

a first hinge plate;

a second hinge plate connected with the first hinge plate; and a hinge accommodation element in which said second hinge plate is adjustably disposed, so as to pivot, with a pin, on a hinge roll, said hinge accommodation element being formed from a front part and a rear part that are connected by a connection screw, wherein the second hinge plate is mounted so it can tilt in a horizontal direction, relative to the hinge accommodation element, and is guided in the hinge accommodation element so as to move in a vertical direction and has projections on its end facing away from the hinge roll, said projections being guided in vertical slits on a bent section of the rear part, and wherein the second hinge plate is adjustable in the hinge accommodation element, in a vertical direction, using an adjustment element.

7. A hinge system according to claim 6, wherein the adjustment element of the third door hinge is configured as a cam that engages into a related recess of the second hinge plate.

* * * * *